US008381427B2

(12) United States Patent
Nill

(10) Patent No.: US 8,381,427 B2
(45) Date of Patent: Feb. 26, 2013

(54) STOCK SYSTEM FOR A SHOULDER-SUPPORTED WEAPON

(76) Inventor: Wilfried Nill, Moessingen (DE)

( * ) Notice: Subject to any disclaimer, the term of this patent is extended or adjusted under 35 U.S.C. 154(b) by 424 days.

(21) Appl. No.: 12/713,028

(22) Filed: Feb. 25, 2010

(65) Prior Publication Data

US 2010/0212205 A1 Aug. 26, 2010

(30) Foreign Application Priority Data

Feb. 26, 2009 (DE) ..... 10 2009 010 768

(51) Int. Cl.
*F41C 23/14* (2006.01)

(52) U.S. Cl. ..... 42/73; 42/71.01; 42/72; 42/74

(58) Field of Classification Search ..... 42/71.01, 42/71.02, 72–74
See application file for complete search history.

(56) References Cited

U.S. PATENT DOCUMENTS

| | | | | |
|---|---|---|---|---|
| 3,137,958 | A * | 6/1964 | Lewis et al. | 42/73 |
| 4,896,446 | A * | 1/1990 | Gregory | 42/73 |
| 5,031,348 | A * | 7/1991 | Carey | 42/74 |
| 6,651,371 | B2 * | 11/2003 | Fitzpatrick et al. | 42/72 |
| 6,874,267 | B2 * | 4/2005 | Fitzpatrick et al. | 42/72 |
| 7,024,812 | B2 * | 4/2006 | Nelson | 42/73 |
| 7,398,616 | B1 * | 7/2008 | Weir | 42/73 |
| 7,536,819 | B2 * | 5/2009 | Popikow | 42/74 |
| 7,930,849 | B2 * | 4/2011 | Abraham et al. | 42/73 |
| 8,087,193 | B2 * | 1/2012 | Kincel | 42/74 |
| 2005/0268516 | A1 * | 12/2005 | Nelson | 42/73 |
| 2006/0174532 | A1 * | 8/2006 | Popikow | 42/73 |
| 2007/0101631 | A1 | 5/2007 | Bentley | |
| 2008/0028662 | A1 * | 2/2008 | Abraham et al. | 42/73 |
| 2008/0236016 | A1 | 10/2008 | Fitzpatrick et al. | |
| 2012/0137561 | A1 * | 6/2012 | Ludlow | 42/75.03 |

FOREIGN PATENT DOCUMENTS

| | | | |
|---|---|---|---|
| DE | 1 854 723 | U1 | 7/1962 |
| DE | 83 07 047 | U1 | 7/1983 |
| DE | 94 11 466 | U1 | 12/1994 |
| DE | 10 2004 057 414 | A1 | 6/2005 |

* cited by examiner

*Primary Examiner* — Jonathan C Weber
(74) *Attorney, Agent, or Firm* — Roberts Mlotkowski Safran & Cole, P.C.

(57) ABSTRACT

A stock system for a shoulder-supported weapon the holding and supporting stock (10) of which for accepting the weapon system comprises:

a pistol grip (12), an at least sideways-adjustable and height-adjusting cheek piece (15), and a pivotable and length-adjustable butt plate unit (16), which are assigned to a middle piece (14) forming part of the stock (10), which is designed as a coupling for creating a positive connection between the weapon system and the stock parts (12, 15, 16) forming the stock (10), which connection can be released by the application of force.

6 Claims, 2 Drawing Sheets

STOCK SYSTEM FOR A SHOULDER-SUPPORTED WEAPON

The invention pertains to a stock system for a shoulder-supported weapon, the holding and supporting stock of which comprises a pistol grip, an at least sideways-adjustable and height-adjustable cheek piece, and a pivotable, length-adjustable butt plate.

Stock systems of this type, many different designs of which are known for right-handed and left-handed shooters, provide the ability to adapt the weapon to the anatomical proportions of the shooter in question, which is of considerable advantage, even for recreational shooters, when aiming at a target.

Adjusting the cheek pieces and butt plates to the side and up or down in relation to the main part of the stock in question is usually is done by the use of guide elements, which cooperate with fastening tabs and can be adjusted and then tightened with screws. Lockable spacer screws are used to set the butt plate at the desired distance; compare, for example, DE 94 11 466 U1 and DE 10 2004 057 414 A1.

Because stock systems of this type require a large number of components of widely differing design, they are not flexible enough, are often difficult and expensive to produce, and are complicated to assemble and to maintain. Setting the distances also leaves much to be desired, especially for recreational shooting, primarily because it has been possible in the past to make only small changes to these distances.

This is the point from which the invention proceeds, the goal of which is to simplify stock systems of this type and in particular to increase the extent to which the distances can be changed, so that it is possible to adapt the system more effectively than in the past to a wide range of arm lengths and of shapes of the shooters' shoulders.

Proceeding from a stock system for a shoulder-supported weapon, the holding and supporting stock of which for accepting the weapon system comprises a pistol grip, an at least sideways-adjustable and height-adjustable cheek piece, and a pivotable, length-adjustable butt plate, this goal is achieved according to the invention by the characterizing features of claim 1.

Additional features of the invention can be derived from the subclaims.

The inventive design of the new stock system replaces the previous main stock part with a middle piece in the center, to which of all the essential parts of the stock system are attached. The pistol grip serves as a connecting means between the weapon system and the middle piece, which carries on its top surface the height-adjustable and sideways-adjustable cheek piece. Designing the carrier of the butt plate, which is supported so that it can rotate and pivot and can be tightened in the desired position, as a telescoping tube, which is provided either with a set of teeth or with a guide roller, can be pushed into and pulled out of the middle piece, and can be clamped to this middle piece by clamping means, makes it possible in a simple and reliable manner to adjust the butt plate of the stock system to the physical proportions of the shooter using the weapon, over a much greater distance. In addition, the inventive design also makes it possible to manufacture the new stock more easily, to design it more flexibly, and to assemble and to maintain it more easily.

The invention is described below on the basis of more-or-less schematic diagrams of an exemplary embodiment:

Figure 1:
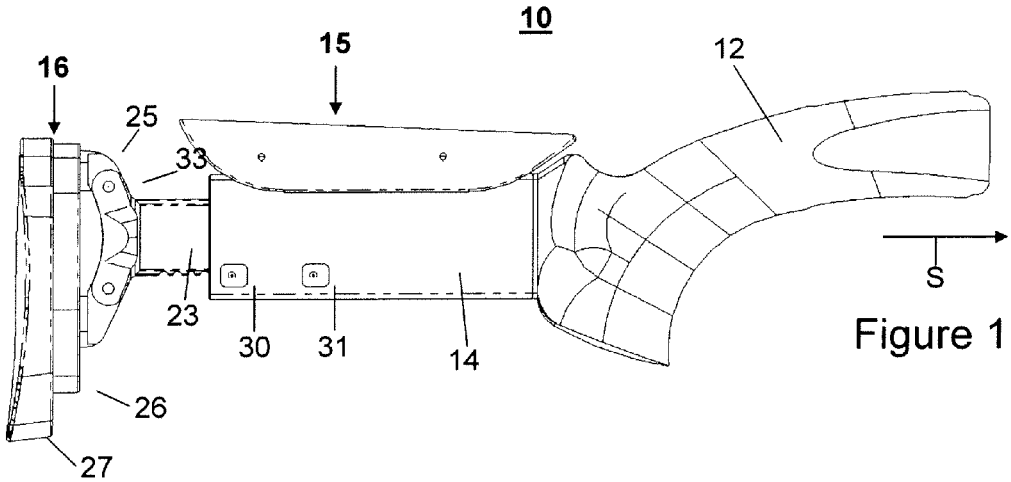
FIG. 1 shows a side view of the stock system.
Figure 2:
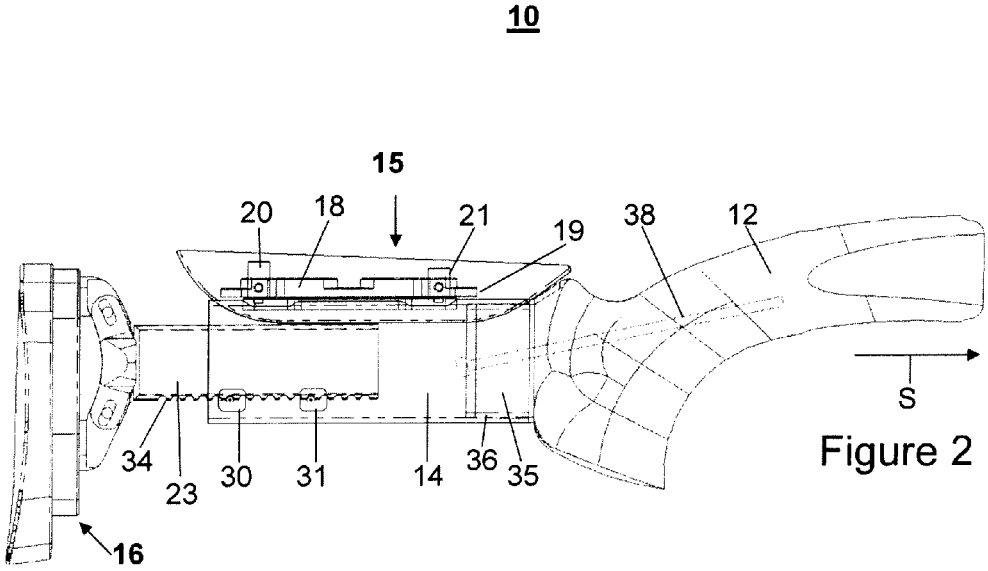
FIG. 2 shows a cross section through the right side of the stock system according to FIG. 1.
Figure 3:
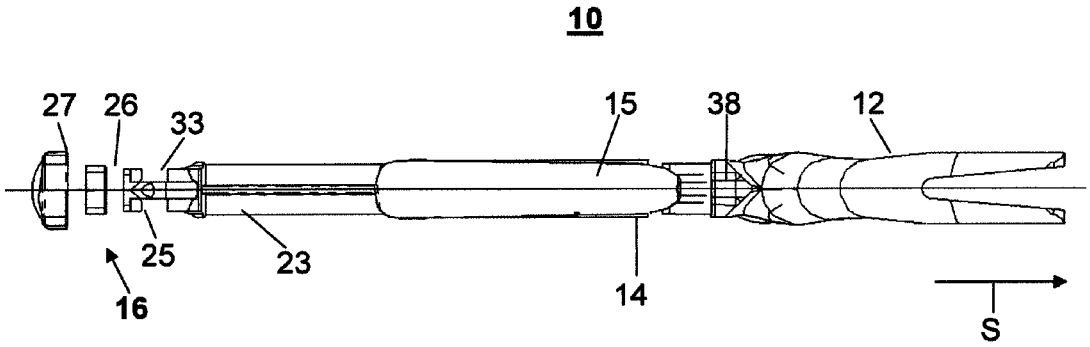
FIG. 3 shows a view of the stock system from above.

A stock system, designated overall in the drawing by the number 10, for a shoulder-supported weapon, e.g., a rifle or a shotgun for sport and hunting purposes or a military weapon, comprises

- a pistol grip 12, which serves as the carrier of a weapon system (not shown) and which possibly also covers the forward end, i.e., forward with respect to the shooting direction, of the weapon system, and
- a middle piece 14, which serves as the carrier of a height-adjustable and sideways adjustable cheek piece 15 and as the carrier of a butt plate unit 16, which can be pivoted and also adjusted lengthwise with respect to the shooting direction S, or of other rigid butt plate units (not shown), which are attached to the rear part of the middle piece.

The adjusting means for the cheek piece 15, which are known in and of themselves and therefore not shown in detail, comprise fastening tabs 18 and 19, designed as guide elements, which can be fixed in the desired adjustment position by means of screw elements 20, 21.

Figure 4:
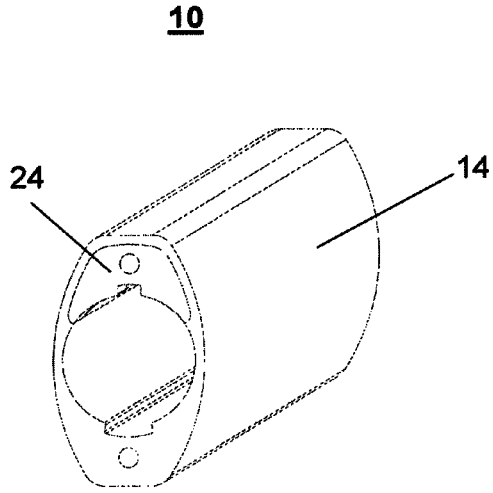
FIG. 4 shows a perspective, partial view of the stock system.

The butt plate unit 16, designed in the known multi-part manner, is hinged to a toothed, telescoping tube 23, supported with freedom to slide in and out of the middle piece 14, namely, at the end facing away from the shooting direction S of the weapon system. The telescoping tube 23 can be adjusted axially by a guide plate 24, which is screwed into the rear part of the middle piece and can thus be clamped firmly to it, this plate also being provided with a groove (see FIG. 4). The butt plate unit 16 itself comprises a pitchfork 33, which is supported so that it can be rotated in the telescoping tube 23 and fixed in the desired position; a pivot plate (fork) 25, which is supported on the pitchfork 33 with freedom to pivot; and a shoulder plate 27, which is connected adjustably to the adjusting plate 26, these two latter parts being held tightly together by screw elements.

For the purpose of adjusting the length of the stock, the screw elements 30, 31 engage in the set of teeth 34 on the telescoping tube 23. So that the length of the stock can be adjusted without any additional tools and with only a few manipulations, it is also possible as an alternative to use a pivoting lever (not shown and known in itself) to clamp the tube, this lever being located in the bottom rear area of the middle piece 14.

As an alternative, a non-adjustable butt plate piece, as a less-expensive and lighter-weight solution, which can be screwed to the rear part of the middle piece, i.e., to the end facing away from the shooting direction, can be used.

The pistol grip 12 has a shoulder 35 by which it engages in a corresponding opening 36 in the middle piece 14 at the end facing away from the butt plate unit (shoulder plate) 16, i.e., facing in the shooting direction S, and is firmly but detachably clamped to the middle piece 14 by a screw 38.

With the stock system described above, the stock of the weapon can be quickly and easily adapted and adjusted individually to suit the shooter in question. The geometric shape of the grip and of the attached elements, especially the cheek piece 15 and the butt plate unit 16, can be designed in various ways to achieve different aesthetic impressions. So that the stock system can be clamped to the weapon system (not shown) with only a few manipulations, a lever, not shown here but known in itself, located on the bottom of the middle piece 14, is used to pull a tie rod, to which a collet chuck is attached, back toward the rear—in the direction opposite the arrow S—so that, by the engagement of the collet chuck in an opposing piece on the weapon system, the stock system 10 can be clamped to the weapon.

The invention claimed is:

1. A stock system for a shoulder-supported weapon system comprising:

a pistol grip, an at least sideways-adjustable and height-adjusting cheek piece, and a pivotable and length-adjustable butt plate unit, the butt plate unit including a pitchfork, a pivoting plate pivotably supported on the pitchfork, and an adjusting plate carrying a butt plate, and a middle piece connecting the pistol grip, the cheek piece, and the butt plate unit including a coupling for creating a positive connection between the weapon system and stock parts forming the stock system, which connection can be released by an application of force, wherein the middle piece surrounds a toothed telescoping tube having a first end hingedly connected the butt plate unit, and a second end which can be clamped to the middle piece by way of a plurality of clamping points spaced apart along the axis of the telescoping tube.

2. A stock system according to claim 1, wherein the pitchfork is supported in the telescoping tube so that it can be rotated and held in a desired position in the telescoping tube.

3. A stock system according to claim 1, wherein the sideways-adjustable and height-adjustable cheek piece is attached to the top surface of the middle piece by guide and fastening tabs, which are clamped to the middle piece by screw elements.

4. A stock system according to claim 1, wherein the pistol grip couples the weapon system and the middle piece by means of a pin which engages in a corresponding opening in the middle piece in the second end facing in a shooting direction (S) and is clamped to the middle piece by means of a screw or a coupling.

5. A stock system according to claim 1, wherein the middle piece is a tubular element with an elliptical cross section, and includes a guide plate provided with a groove that guides the telescoping tube in the middle piece.

6. A stock system according to claim 1, wherein the telescoping tube surrounded by the middle piece is detachably connected to the butt plate.

* * * * *